US007890197B2

(12) United States Patent
Francino et al.

(10) Patent No.: US 7,890,197 B2
(45) Date of Patent: Feb. 15, 2011

(54) DUAL MODEL APPROACH FOR BOILER SECTION CLEANLINESS CALCULATION

(75) Inventors: Peter N. Francino, Renfrew, PA (US); Xu Cheng, Pittsburgh, PA (US)

(73) Assignee: Emerson Process Management Power & Water Solutions, Inc., Pittsburgh, PA (US)

( * ) Notice: Subject to any disclaimer, the term of this patent is extended or adjusted under 35 U.S.C. 154(b) by 691 days.

(21) Appl. No.: 11/848,843

(22) Filed: Aug. 31, 2007

(65) Prior Publication Data

US 2009/0063113 A1 Mar. 5, 2009

(51) Int. Cl.
*G05B 13/02* (2006.01)

(52) U.S. Cl. ..... 700/30; 700/19; 700/31; 122/1 R; 703/7

(58) Field of Classification Search ..... 700/19, 700/29, 30, 31, 32; 122/1 R; 703/6, 7
See application file for complete search history.

(56) References Cited

U.S. PATENT DOCUMENTS

| | | | | |
|---|---|---|---|---|
| 4,466,383 | A | 8/1984 | Klatt et al. | 122/379 |
| 4,539,840 | A | 9/1985 | Klatt et al. | 73/112 |
| 6,758,168 | B2 | 7/2004 | Koskinen et al. | 122/7 R |
| 2006/0283406 | A1 | 12/2006 | Francino et al. | 122/379 |
| 2007/0225835 | A1* | 9/2007 | Zhu | 700/44 |
| 2008/0210178 | A1* | 9/2008 | Frach et al. | 122/1 R |

FOREIGN PATENT DOCUMENTS

GB 2 428 312 1/2007

OTHER PUBLICATIONS

Craig Clark, Intelligent Soot Blowing Installation Experience at Homer City, Mar. 13, 2007, all pages.*
Cheng et al., "Intelligent Sootblower Scheduling for Improved Boiler Operation," pp. 1-11, Westinghouse Process Control, Inc., presented Jun. 1999 at POWID/EPRI Instrument and Control Conference in St. Petersburg, Florida.
International Search Report, International Application No. GB0815696.0, dated Dec. 2, 2008.

* cited by examiner

*Primary Examiner*—Paul L Rodriguez
*Assistant Examiner*—Nathan Laughlin
(74) *Attorney, Agent, or Firm*—Marshall, Gerstein & Borun LLP

(57) ABSTRACT

A method of controlling soot blowers near a heat exchange section includes generating models of both the ideal clean operating condition of the section and the dirty operating condition. The current operating condition of the section is used to calculate a reliability parameter that provides an indication of the reliability of the ideal and dirty models. If the reliability parameter indicates that the models are reliable, the models are used to help evaluate the cleanliness status of a particular heat exchange section and assist in making decisions on whether to blow the section or not, and whether to make any necessary adjustments to the operating sequence of the soot blowers. If the reliability parameter indicates that the models are unreliable, the models are regenerated using additional process data.

24 Claims, 5 Drawing Sheets

DUAL MODEL APPROACH FOR BOILER SECTION CLEANLINESS CALCULATION

TECHNICAL FIELD

This patent relates generally to computer software, and more particularly to computer software used in controlling soot blowing operations.

BACKGROUND

A variety of industrial as well as non-industrial applications use fuel burning boilers, typically for converting chemical energy into thermal energy by burning one of various types of fuels, such as coal, gas, oil, waste material, etc. An exemplary use of fuel burning boilers is in thermal power generators, wherein fuel burning boilers are used to generate steam from water traveling through a number of pipes and tubes in the boiler and the steam is then used to generate electricity in one or more turbines. The output of a thermal power generator is a function of the amount of heat generated in a boiler, wherein the amount of heat is determined by the amount of fuel that can be burned per hour, etc. Additionally, the output of the thermal power generator may also be dependent upon the heat transfer efficiency of the boiler used to burn the fuel.

Burning of certain types of fuel, such as coal, oil, waste material, etc., generates a substantial amount of soot, slag, ash and other deposits (generally referred to as "soot") on various surfaces in the boilers, including the inner walls of the boiler as well as on the exterior walls of the tubes carrying water through the boiler. The soot deposited in the boiler has various deleterious effects on the rate of heat transferred from the boiler to the water, and thus on the efficiency of any system using such boilers. It is necessary to address the problem of soot in fuel burning boilers that burn coal, oil, and other such fuels that generate soot in order to maintain a desired efficiency within the boiler. While not all fuel burning boilers generate soot, for the remainder of this patent, the term "fuel burning boilers" is used to refer to those boilers that generate soot.

Various solutions have been developed to address the problems caused by the generation and presence of soot deposits in boilers of fuel burning boilers. One approach is the use of soot blowers to remove soot encrustations accumulated on boiler surfaces through the creation of mechanical and thermal shock. Another approach is to use various types of soot blowers to spray cleaning materials through nozzles, which are located on the gas side of the boiler walls and/or on other heat exchange surfaces, where such soot blowers use any of the various media such as saturated steam, superheated steam, compressed air, water, etc., for removing soot from the boilers.

Soot blowing affects the efficiency and the expense of operating a fuel burning boiler. For example, if inadequate soot blowing is applied in a boiler, it results in excessive soot deposits on the surfaces of various steam carrying pipes and therefore in lower heat transfer rates. In some cases, inadequate soot blowing may result in "permanent fouling" within fuel burning boilers, meaning that soot deposits in the boiler are so excessive that such deposits cannot be removed by any additional soot blowing. In such a case, forced outage of the boiler operation may be required to fix the problem of excessive soot deposits, and boiler maintenance personnel may have to manually remove the soot deposits using hammers and chisels. Such forced outages are not only expensive, but also disruptive for the systems using such fuel burning boilers.

On the other hand, excessive soot blowing in fuel burning boilers may result in increased energy cost to operate the soot blowers, wastage of steam that could otherwise be used to operate turbines, etc. Excessive soot blowing may also be linked to boiler wall tube thinning, tube leaks, etc., which may cause forced outages of boiler use. Therefore, the soot blowing process needs to be carefully controlled.

Historically, soot blowing in utility boilers has been mostly an ad hoc practice, generally relying on a boiler operator's judgment. Such an ad hoc approach produces very inconsistent results. Therefore, it is important to manage the process of soot blowing more effectively and in a manner so that the efficiency of boiler operations is maximized and the cost associated with the soot blowing operations is minimized. One measure that has been used in soot blowing control is the cleanliness of the boiler or heat exchanger. The cleanliness may be expressed in terms of a cleanliness factor CF that is a measure of how close the actual operating conditions of the boiler or heat exchanger are to the ideal operating conditions. In some control methods, the heat absorption of the boiler or heat exchanger serves as the basis for determining the cleanliness, with $CF=Q_{actual}/Q_{ideal}$, where $Q_{actual}$ is the current actual heat absorption and $Q_{ideal}$ is the achievable ideal heat absorption after cleaning. Of course, other relevant parameters that vary as the cleanliness of the boiler or heat exchanger varies may be used to calculate a cleanliness factor. When the boiler or heat exchanger is operating near the optimal efficiency, $Q_{actual}$ approaches $Q_{ideal}$ and $CF \approx 1$. As CF varies during operation, the soot blowing operation is adjusted to increase heat absorption to a desired level by the boiler operators.

One popular method used for determining cleanliness of a boiler section and to control soot blowing operations is a first principle based method, which requires measurements of flue gas temperature and steam temperature at the boiler section inlets and outlets. However, because direct measurements of flue gas temperatures are not always available, the flue gas temperatures are often backward calculated at multiple points along the path of the flue gas, starting from the known flue gas temperatures measured at an air heater outlet. This method is quite sensitive to disturbances and variations in air heater outlet flue gas temperatures and fuel changes, often resulting in incorrect results. Moreover, this method is a steady state method, and therefore does not work well in transient processes generally encountered in various boiler sections.

Another popular method used for determining cleanliness of a boiler section of a fuel burning boiler and to control soot blowing operations in a fuel burning boiler is an empirical model based method, which relies on an empirical model such as a neural network model, a polynomial fit model, etc. The empirical model based method generally requires a large quantity of empirical data related to a number of parameters, such as the fuel flow rate, the air flow rate, the air temperature, the water/steam temperature, the burner tilt, etc. Unfortunately the large amount of data makes the data collection process tedious and prone to high amount of errors in data collection.

Another method used to control soot blowing operations in a fuel burning boiler is disclosed in U.S. Patent Publ. No. 2006/0283406 A1, by Francino et al., published on Dec. 21, 2006, entitled "Method and Apparatus for Controlling Soot Blowing Using Statistical Process Control," the disclosure of which is expressly incorporated herein. Francino et al. discloses a statistical process control system employing a consistent soot blowing operation for a heat exchange section of, for example, a fuel burning boiler, collecting heat absorption data for the heat exchange section and analyzing the distribution of the heat absorption data as well as various parameters of the heat absorption distribution to readjust the soot blowing operation. The statistical process control system may set a desired lower heat absorption limit and a desired upper heat absorption limit and compare them, respectively, with an actual lower heat absorption limit and an actual upper heat absorption limit to determine the readjustment to be made to the soot blowing practice.

Generally speaking, the statistical process control system is simple to implement as the statistical process control system requires only heat absorption data for implementation. Moreover, because the statistical process control system uses heat absorption data, it is independent of, and not generally effected by disturbances and noise in flue gas temperatures, thus providing uniform control over operation of soot blowers and cleanliness of heat exchange sections. An implementation of the statistical process control system measures heat absorption at various points over time to determine differences in heat absorption before and after a soot blowing operation, and calculates various statistical process control measurements based on such heat absorption statistics to determine the effectiveness of the soot blowing operation. The statistical process control system establishes a consistent soot blowing operation for the heat exchange section of a boiler or other machines and reduces the amount of data necessary for controlling the operation of the soot blowers.

In these and other intelligent soot blowing methods, the actual operating conditions of the boiler or boiler section are compared to the ideally clean conditions to control the sequence, timing and duration of actuation of the various soot blowers of the section. The comparison is also used to determine when the permanent soot buildup in the section is so great that the boiler must be shut down for cleaning. In the soot blowing methods, data relating to the operation of a boiler section is collected at the boiler section over a period of time, and the performance of the boiler section is modeled to express a relevant thermodynamic parameter as a function of the other measured thermodynamic parameters. For example, in some implementations, the heat absorption Q of the boiler section is modeled as a function of the steam flow rate $F_s$, the steam temperature at the inlet $T_{si}$ and the flue gas temperature at the inlet $T_{gi}$. Of course, the particular method may be configured to model other meaningful parameters of the boiler section.

Regardless of the modeled parameter, the intelligent soot blowing methods typically use only one ideal model or benchmark per section to which the current conditions within the boiler section are compared. Soot blowing can be properly controlled using a single model if the generated model provides an accurate depiction of the operation of the boiler section. However, if the generated model is not accurate, the control of the soot blowing operation may cause the operation and, consequently, the boiler section to operate with less efficiency than can be attained with an accurate model. Inaccuracies in the model may be caused by many factors, such as the inability to directly measure certain parameters that are meaningful to the modeling of the boiler section, sensitivity within a given method to disturbances and variations in parameters, the completeness and accuracy of the data provided to the modeling software, and the like. Because only a single model or benchmark is used, it is often difficult to determine whether the generated model is accurate and reliable for the purposes of controlling the soot blowing operation. As a result, a need exists for an improved method of controlling the soot blowing operation of the boiler sections that facilitates the identification of inaccuracies and unreliability of the generated models so that the models may be adjusted or recalculated if necessary to ensure that the soot blowing operation is being performed as efficiently as possible.

BRIEF DESCRIPTION OF THE DRAWINGS

The present patent is illustrated by way of examples and not limitations in the accompanying figures, in which like references indicate similar elements, and in which.

DETAILED DESCRIPTION OF THE EXAMPLES

Figure 1:
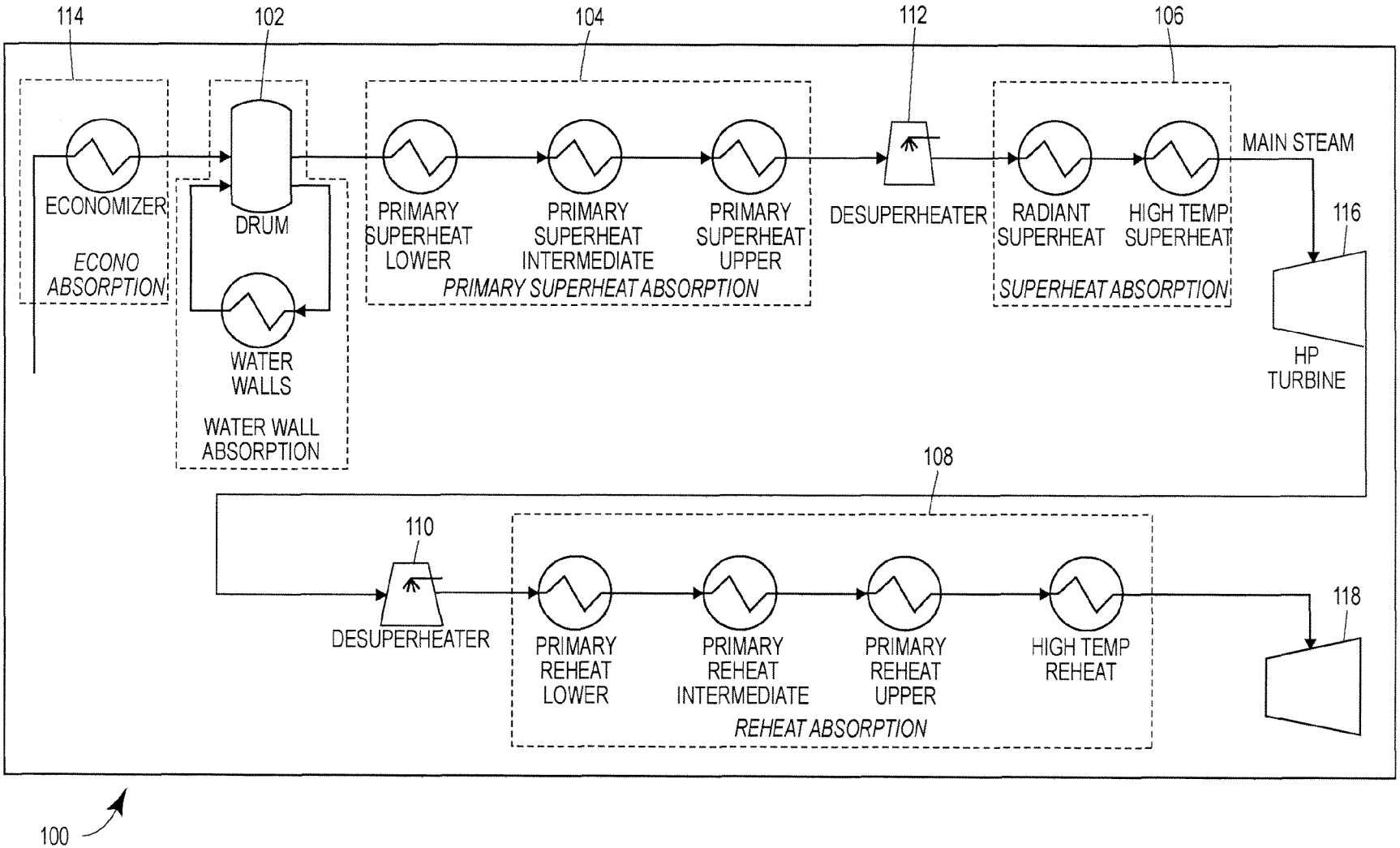
FIG. 1 illustrates a block diagram of a boiler steam cycle for a typical boiler.

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

The reliability of presently known soot blowing control methods is improved by introducing the concept of a second model (or second set of models) that has as its basis the dirty, fouled or slagged condition of the boiler or heat exchanger to add an additional dimension of information to the process of controlling the soot blowing operation. The second model introduces the concept of a dirtiness factor DF that measures how close the boiler or heat exchanger is to the point at which the device must be cleaned. The same types of modeling methods can be used for the dirty model development as are used for the clean model development, whether they are empirical, first principle, statistical in nature or other. The dirtiness factor DF is the output of comparing the dirty condition heat absorption with the actual heat absorption, with $DF=Q_{dirty}/Q_{actual}$, where $Q_{dirty}$ is the heat absorption at the point that the device is considered fouled or in definite need of cleaning attention. It should be noted that this technique need not rely on heat absorptions as the comparison measure of DF and CF. Other parameters that vary with changing cleanliness or dirtiness could also be used as the arbiter of boiler or boiler section condition.

FIG. 1 illustrates a block diagram of a boiler steam cycle for a typical boiler 100 that may be used, for example, by a thermal power plant. The boiler 100 may include various sections through which steam or water flows in various forms such as superheated steam, reheat steam, etc. While the boiler 100 illustrated in FIG. 1 has various boiler sections situated horizontally, in an actual implementation, one or more of these sections may be positioned vertically, especially because flue gases heating the steam in various boiler sections, such as a water wall absorption section, rise vertically.

The boiler 100 includes a water wall absorption section 102, a primary superheat absorption section 104, a superheat absorption section 106 and a reheat section 108. Additionally, the boiler 100 may also include one or more de-superheaters 110 and 112 and an economizer section 114. The main steam generated by the boiler 100 is used to drive a high pressure (HP) turbine 116 and the hot reheat steam coming from the reheat section 108 is used to drive an intermediate pressure (IP) turbine 118. Typically, the boiler 100 may also be used to drive a low pressure (LP) turbine, which is not shown in FIG. 1.

The water wall absorption section 102, which is primarily responsible for generating steam, includes a number of pipes through which steam enters a drum in this drum boiler example. The feed water coming into the water wall absorption section 102 may be pumped through the economizer section 114. The feed water absorbs a large amount of heat when in the water wall absorption section 102. The water wall absorption section 102 has a steam drum, which contains both water and steam, and the water level in the drum has to be carefully controlled. The steam collected at the top of the steam drum is fed to the primary superheat absorption section 104, and then to the superheat absorption section 106, which together raise the steam temperature to very high levels. The main steam output from the superheat absorption section 106 drives the high pressure turbine 116 to generate electricity.

Once the main steam drives the HP turbine 116, the steam is routed to the reheat absorption section 108, and the hot reheat steam output from the reheat absorption section 108 is used to drive the IP turbine 118. The de-superheaters 110 and 112 may be used to control the final steam temperature to be at desired set-points. Finally, the steam from the IP turbine 118 may be fed through an LP turbine (not shown here) to a steam condenser (not shown here), where the steam is condensed to a liquid form, and the cycle begins again with various boiler feed pumps pumping the feed water for the next cycle. The economizer section 114 that is located in the flow of hot exhaust gases exiting from the boiler uses the hot gases to transfer additional heat to the feed water before the feed water enters the water wall absorption section 102.

Figure 2:
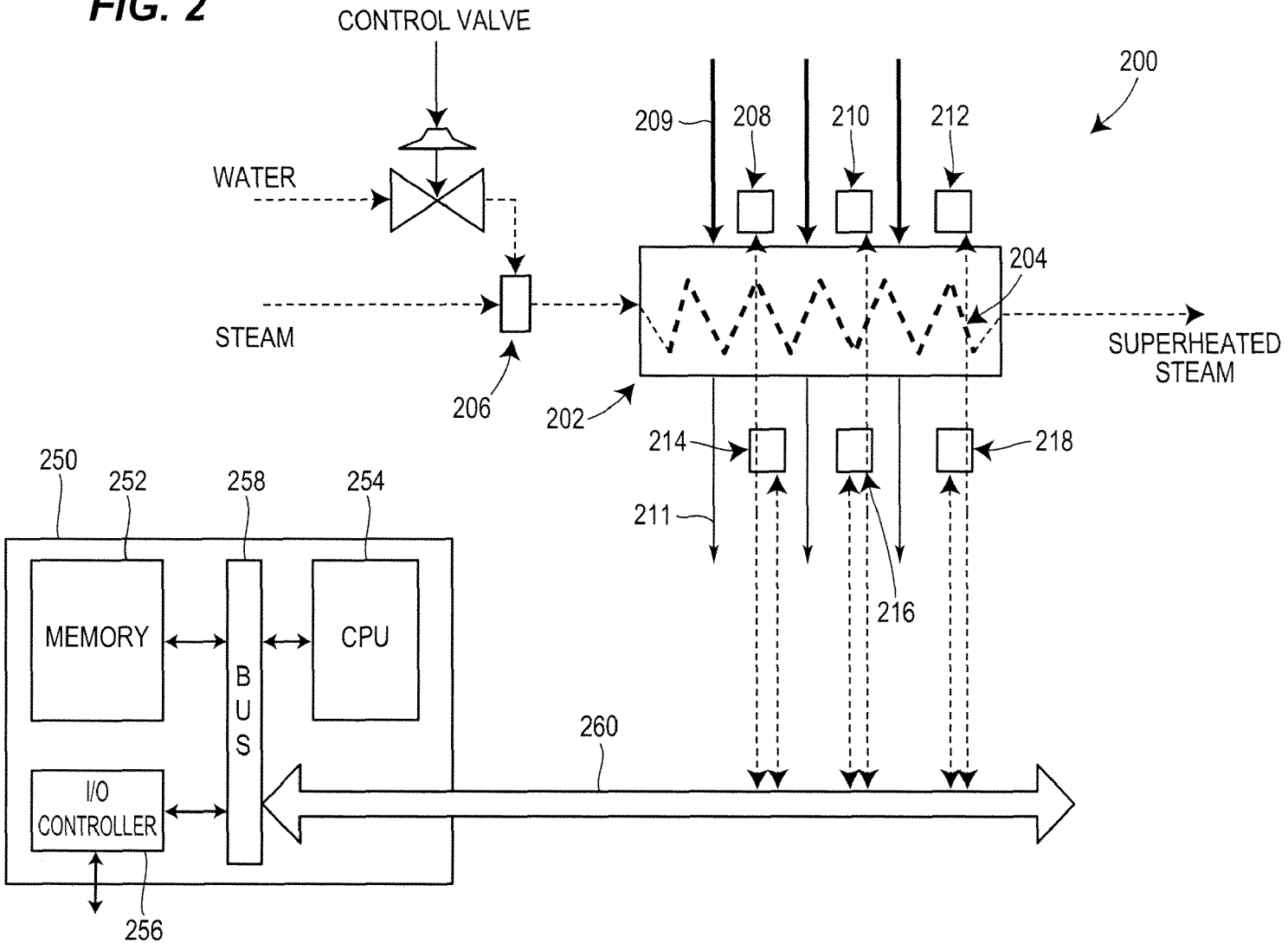
FIG. 2 illustrates a schematic diagram of an exemplary boiler section using a plurality of soot blowers.

FIG. 2 is a schematic diagram of a boiler section 200 having a heat exchanger 202 located in the path of flue gas from the boiler 100. The boiler section 200 may be part of any of the various heat exchange sections described above, such as the primary superheat absorption section 104, the reheat absorption section 108, etc. One of ordinary skill in the art would appreciate that, while the present example of the boiler section 200 may be located in a specific part of the boiler 100, the soot blower control method illustrated in this patent can be applied to any section of the boiler where heat exchange and soot build-up may occur.

The heat exchanger 202 includes a number of tubes 204 for carrying steam which is mixed together with spray water in a mixer 206. The heat exchanger 202 may convert the mixture of the water and steam to superheated steam. The flue gases input to the section 200 are shown schematically by the arrows 209, and the flue gases leaving the boiler section 200 are shown schematically by the arrows 211. The boiler section 200 is shown to include six soot blowers 208, 210, 212, 214, 216 and 218, for removal of soot from the external surface of the heat exchanger 202.

The operation of the soot blowers 208, 210, 212, 214, 216 and 218 may be controlled by an operator via a computer 250. The computer 250 may be designed to store one or more computer programs on a memory 252, which may be in the form of random access memory (RAM), read-only memory (ROM), etc., wherein such a program may be adapted to be processed on a central processing unit (CPU) 254 of the computer 250. A user may communicate with the computer 250 via an input/output controller 256. Each of the various components of the computer 250 may communicate with each other via an internal bus 258, which may also be used to communicate with an external bus 260. The computer 250 may communicate with each of the various soot blowers 208, 210, 212, 214, 216 and 218 using the external communication bus 260.

The soot blowers 208-218 may be operated according to a particular soot blowing sequence, specifying the order in which each of the soot blowers 208-218 is to be turned on, the frequency of operation of the soot blowers 208-218, the length of time each soot blower is on, etc. While a given section of a fuel burning boiler may have a number of different heat exchange sections, the supply of steam and water that may be used for soot blowing operations is limited. Therefore, each heat exchange section is assigned a priority level according to which the soot blowers of that heat exchange section are operated. Soot blowers in a heat exchange section with a higher priority will receive needed water and steam to operate fully and the soot blowers in heat exchange sections with lower priorities will operate only when the needed water and steam are available. As described in further detail below, the priority level of a particular heat exchange section may be changed according to a program implemented for controlling the soot blowers of that particular heat exchange section.

Figure 3:
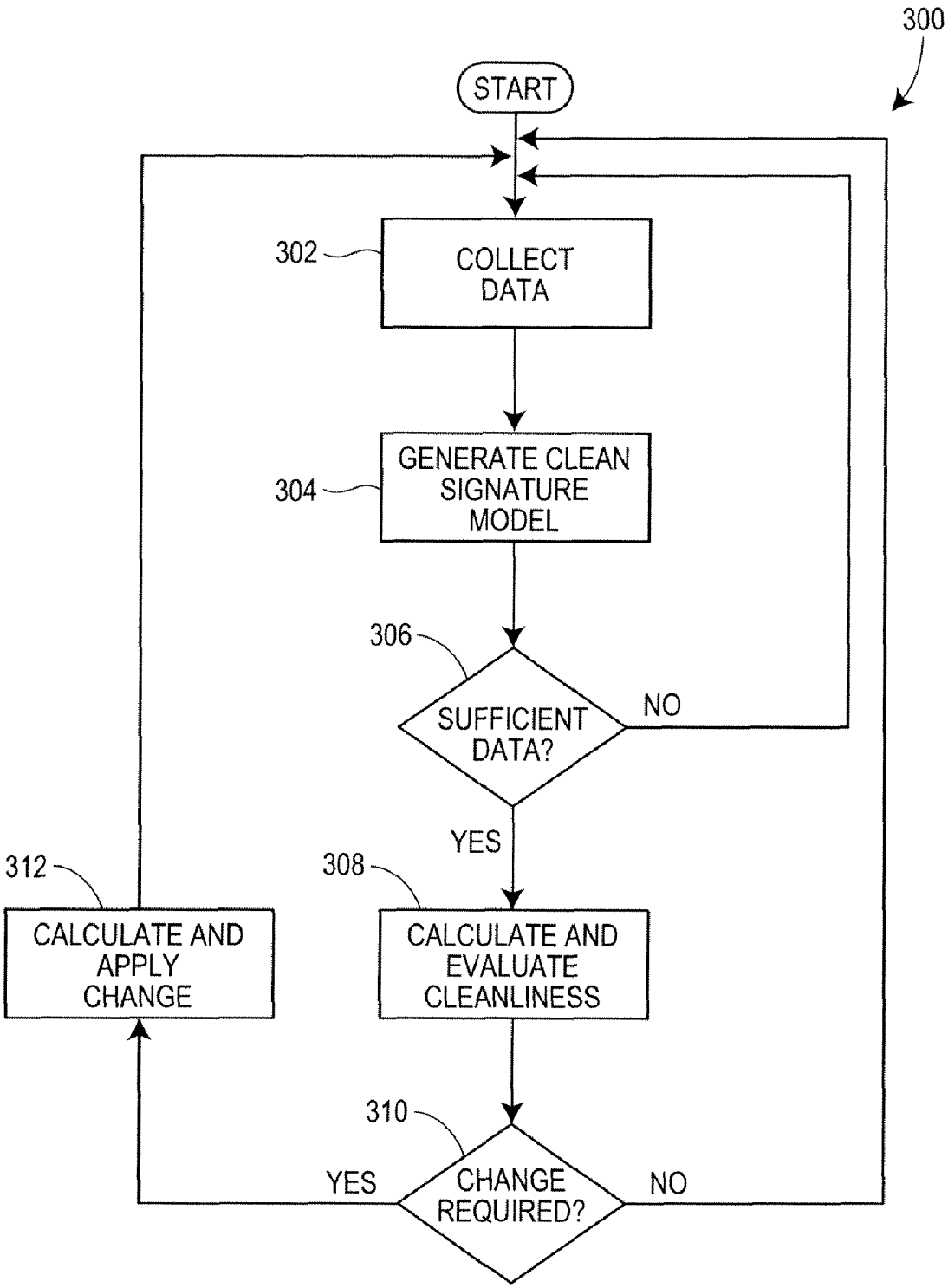
FIG. 3 illustrates a flowchart of an exemplary soot blowing operation control program.

FIG. 3 illustrates a flowchart of a typical soot blowing operation control program 300 that may be used to generate a model of the cleanliness signature for any of the various sections of the boiler 100, such as the boiler section 200, and to control the adjustments to the soot blowing operations. The control program 300 may be implemented as software, hardware, firmware or as any combination thereof. When implemented as software, the control program 300 may be stored on a read only memory (ROM), a random access memory (RAM) or any other memory device used by a computer used to implement the control program 300. The control program 300 may be used to control the soot blowing operations of only one section of the boiler 100 or, alternatively, may be used to control the soot blowing operations of all the heat exchange sections in the boiler 100.

A block 302 initiates the control program 300 by collecting data from the controlled boiler section 200 that will be used to generate the model for the boiler section 200. The particular data to be collected will be determined based on the modeling method implemented in the program 300, the model to be constructed, the parameter to be used in evaluating the condition of the boiler section, the parameters for which sensors provide measurements, and the like. For example, where a first principle based method is implemented to model the heat absorption of the boiler section 200, a log-mean temperature differential is used that requires, among other parameters, the flue gas and steam temperature measurements at the inlet and outlet of the boiler section 200. The cleanliness factor $CF=Q_{actual}/Q_{ideal}$ or $CF=\mu_{actual}/\mu_{ideal}$, where the heat absorption $Q=\mu*A*T_{lm}$ and $\mu$ is the heat transfer effectiveness coefficient. The log-mean temperature difference $T_{lm}$ is calculated using the following equation:

$$T_{lm} = \frac{(T_{gi} - T_{so}) - (T_{go} - T_{si})}{\log((T_{gi} - T_{so})/(T_{go} - T_{si}))}$$

Where:

$T_{gi}$=inlet flue gas temperature $T_{go}$=outlet flue gas temperature $T_{si}$=inlet steam temperature $T_{so}$=outlet steam temperature Where an empirical model based method, such as a polynomial fit or neural network, empirical data is relied on for generating the model. The empirical model relies on information such as fuel flow, air flow, air temperature, feedwater flow, section inlet water/steam temperature, superheat spray, burner tilt, furnace to windbox pressure, flue gas temperature (if available), other section heat absorptions, previous state of heat absorptions and the like. Where statistical process control as taught in the Francino et al. publication is implemented, the block 302 may collect the temperature and pressure of the steam entering and exiting the boiler section 200, which may be used to calculate the entering and exiting enthalpies of the section 200, respectively, and the rate of steam flow into the section 200, which will then be used to calculate the heat absorption within the boiler section 200. The various parameters are used in determining a timeline for operating each of the plurality of blowers within the boiler section, such as boiler section 200. For example, the timeline may specify the frequency at which the soot blower 208 is turned on, the length of time for which the soot blower 208 is kept on, and the length of time for which the soot blower 208 is turned off between two consecutive periods.

As data is collected at the block 302, control passes to a block 304 wherein the data is used to generate a clean signature model of the boiler section 200. Those skilled in the art will be familiar with the details of the modeling methods discussed above and other known methods, and the generation of the clean signature models and, consequently, a thorough discussion is not provided herein. Also at block 304, the heat absorption or other parameter indicative of the condition of the boiler section 200 are calculated and stored using the data collected at block 302. Depending on the implementation and the parameters, the parameters may be either calculated or measured directly by appropriate sensors.

At a block 306, the amount of data collected and stored at block 304 is evaluated. For example, a user may specify that the number of observations that must be collected by the program 300, in which case, the collected data is compared to the user specification at block 306. If more data is necessary, control passes back to the block 302 to collect more data.

When the program 300 determines that a sufficient amount of data has been collected at block 306, control passes to a block 308 wherein the program 300 calculates and evaluates the cleanliness factor CF for the boiler section 200. The program 300 uses the corresponding model to calculate the clean or ideal value of the condition parameter, such as the heat absorption. The program 300 also calculates the actual or current value of the parameter using formulas typically used with a given method. For example, a first principle based method may calculate the heat absorption using the log-mean temperature difference as discussed above. Alternatively, a method may use the enthalpy, or heat energy content expressed as Btu/lb, of the steam flowing through the boiler section 200 to determine the heat absorption. For example, the temperature and pressure of the steam entering the boiler section 200 and exiting from the boiler section 200 may be collected at the block 302, and the entering enthalpy $H_i$ and exiting enthalpy $H_o$, respectively, may be calculated at block 304 or block 308. The rate of steam flow F (lbs/hr) into the boiler section 200 is also collected and the actual heat absorption $Q_{actual}$ of the boiler section 200 may be calculated as:

$$Q_{actual}=F*(H_o-H_i)$$

With $Q_{ideal}$ and $Q_{actual}$ calculated, the cleanliness factor CF is calculated as $Q_{actual}/Q_{ideal}$. In a manner known in the art, the program 300 at block 308 evaluates the current and previous values of $Q_{actual}$ and the cleanliness factor CF to determine whether the soot blower operation must be modified to have $Q_{actual}$ approach $Q_{ideal}$ and, correspondingly, have CF approach 1.

After evaluating the heat absorption and cleanliness factors at the block 308, control passes to a block 310 to determine whether it is necessary to change the current operational sequencing of the soot blowers. For example, the block 310 may determine that it is necessary to change at least one of the frequencies at which the soot blowers are turned on, the length of time that the soot blowers are kept on, the length of time that the soot blowers are turned off between two consecutive on time periods, and the like. Consequently, in an implementation of the heat absorption statistics calculation program disclosed in the Francino et al. publication, the block 310 may determine that if an actual heat absorption mean is lower than a target lower control limit, then it is necessary to change one or more of the operating parameters of the current blowing practice.

If the block 310 determines that it is necessary to change the current operational practice of soot blowing, a block 312 determines a change to be applied to any of the various parameters of the current operational sequencing. The block 312 may use various values of the parameters collected at the block 302 and other values calculated at the block 308 to determine the change to be applied to the operating parameters of the current operational sequencing. For example, in the implementation of the heat absorption statistics calculation program of the Francino et al. publication, the block 312 may determine that the change to be applied to the length of time for which the soot blowers are to be kept on should be a function of the difference between the actual heat absorption mean and the target lower control limit. However, the block 312 may also determine that the soot blowing is working effectively, and that it is not necessary to change the current approach, in which case the control may transfer to the block 302 for continuous monitoring of the soot blowing process without any changes.

Each of the known modeling methods may be affected by the actual data available and other factors such that the generated models at times may not accurately model the boiler section 200. For example, the first principle based method may, at times, yield an inaccurate model because flue gas temperature measurements are not always available or there is a variation in fuel properties. In such implementations, flue gas temperatures are backward calculated at multiple points along the flue gas path based on the heat balance equations that start from the available flue gas temperature measurement at the air heater outlet. This method is sensitive to disturbance and variation in the air heater outlet flue gas temperature. Any error will be carried over throughout the calculations of upstream boiler sections. Additionally, because the first principle based method is a steady state method, it may not work well at times due to process transience. In the empirical model based method, the completeness and accuracy of the data directly affects the effectiveness of the model. In present systems where only a single model is generated for the boiler section or other portion of the boiler, it is difficult to detect errors and to correct the model in a timely manner. In order to detect errors in the generated models, and to increase the reliability of and confidence in the models, a second model or second set of models is introduced to add an additional dimension of information to the analysis and control of the soot blowing operation.

Figure 4:
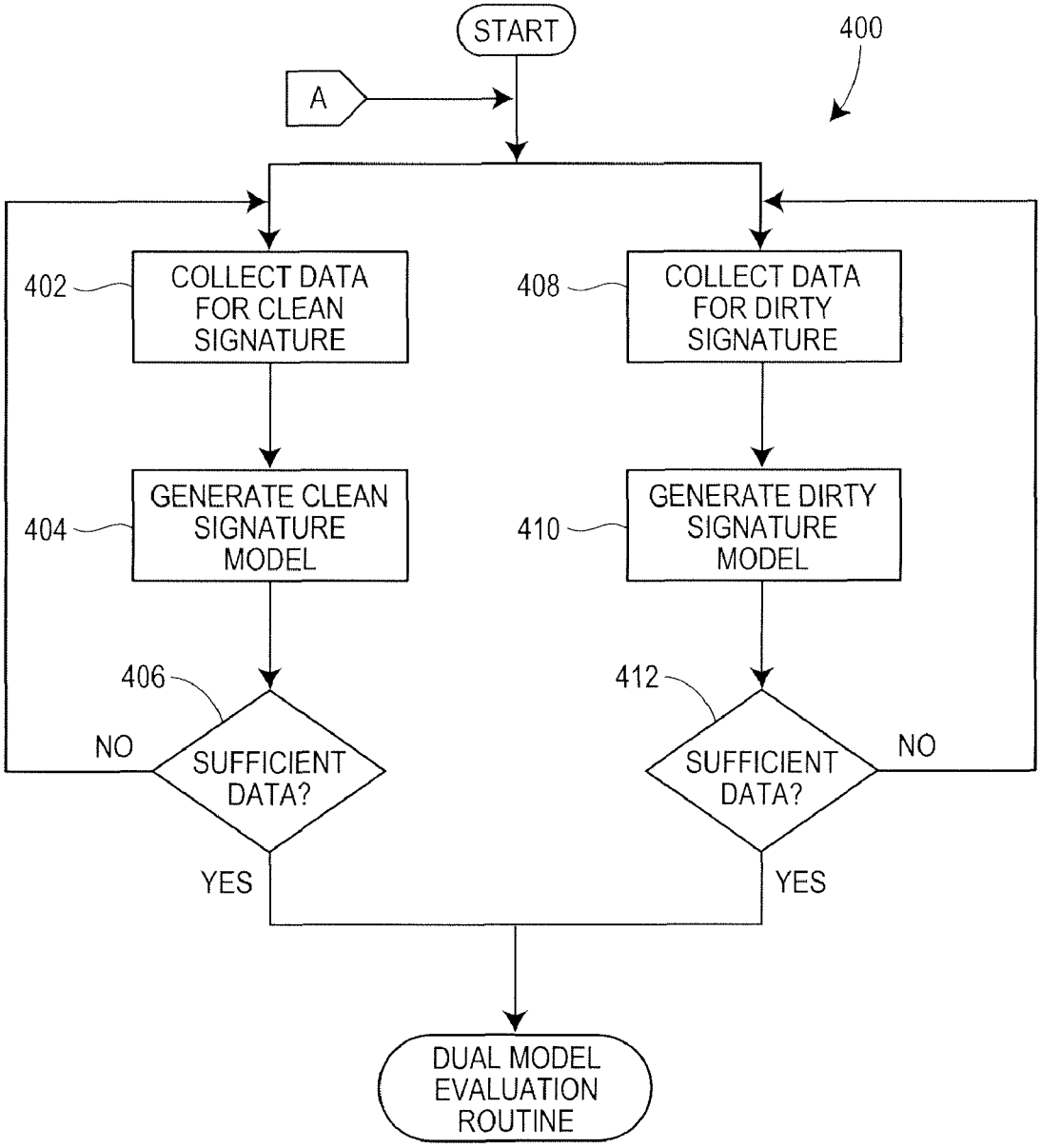
FIG. 4 illustrates a flowchart of a dual model generation routine for a soot blowing process control program in accordance with the present disclosure.
Figure 5:
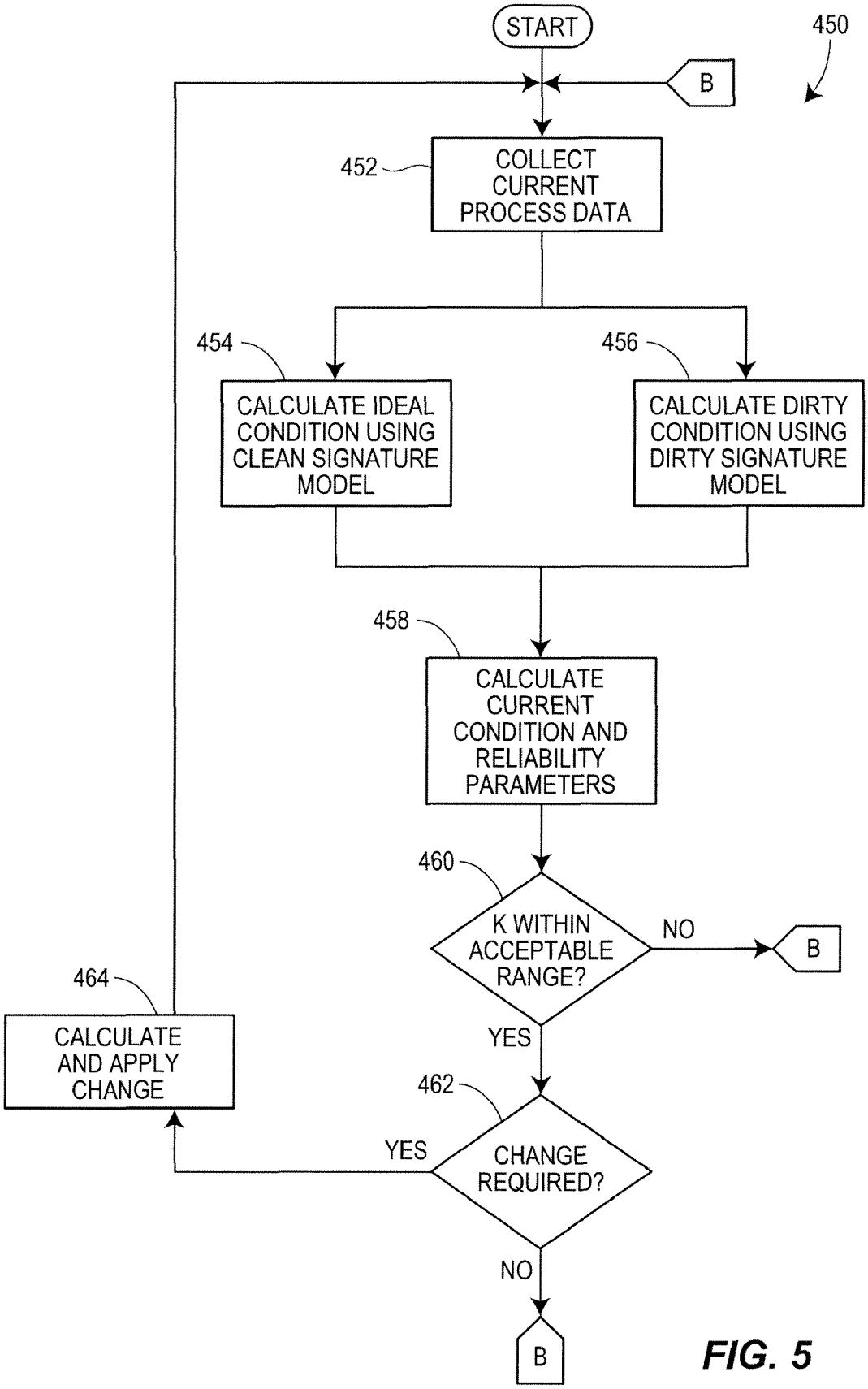
FIG. 5 illustrates a flowchart of a dual model evaluation routine for the soot blowing process control program.

FIGS. 4 and 5 illustrate flowcharts for a dual model generation routine 400 and a dual model evaluation routine 450 of a process control program that modifies the currently known control program 300 to implement a dual model approach for improved boiler section cleanliness calculations. As with the control program 300, the routines 400, 450 may be implemented as software, hardware, firmware or as any combination thereof. When implemented as software, the routines 400, 450 may be stored on a read only memory (ROM), a random access memory (RAM) or any other memory device used by a computer used to implement the routines 400, 450 of the control program. The routines 400, 450 of the control program may be used to control the soot blowing operations of only one section of the boiler 100 or, alternatively, may be used to control the soot blowing operations of all the heat exchange sections in the boiler 100.

Referring to FIG. 4, the dual model generation routine 400 includes two separate paths that are each similar to the flow and processing of the blocks 302-306 of the control program 300. On the left side of FIG. 4, blocks 402-406 collect data for the clean signature of the boiler section 200, generate a clean signature model of the boiler section 200, and determine whether sufficient data has been gathered for the clean signature model, respectively. As in the control program 300, blocks 402-406 may implement a first principle based method, an empirical model based method, a statistical process control approach, or any other known intelligent method for determining a clean signature model of the boiler section 200.

At the same time blocks 402-406 are generating a clean signature model of the boiler section 200, blocks 408-412 are generating a dirty signature model that is predictive of the dirtiest condition of the boiler section 200. The dirtiest condition of the boiler section 200 is the point at which sufficient soot has accumulated within the boiler section 200 that the boiler section 200 must be taken out of service for cleaning. Consequently, the block 408 initiates the dirty signature model generation portion of the routine 400 by collecting data from the controlled boiler section 200 that will be used to generate the dirty signature model of the boiler section 200. As with the data collected at the block 402, the particular data to be collected at block 408 is determined by the modeling method implemented in the routine 400, the model being constructed, the condition-indicating parameter, and the parameters for which data is available. While the data collected for the dirty signature model may be the same as the data for the clean signature model, other data that is more relevant to the dirty condition of the boiler section 200 may be collected and used in generating the dirty signature model.

As the data is collected at the block 408, a block 410 uses the collected data to generate the dirty signature model of the boiler section 200. Any known modeling method such as those discussed above may be implemented to generate the dirty signature model. However, whereas the methods for generating the clean signature model are configured to model the characteristics of the boiler section 200 as the performance degrades from the ideal clean condition, the methods for generating the dirty signature model are configured to model the characteristics of the boiler section 200 as it approaches the dirtiest allowable condition when generating the dirty signature model. Such configurations of the known methods for modeling the worst case operating conditions of the boiler section 200 will be apparent to those skilled in the art. In most implementations, the same base method may be used for both the clean model and the dirty model. However, different methods may be used if desired, such as where one method is known to be particularly accurate at modeling the clean signature of the boiler section 200 and another method is more accurate for modeling the dirty signature.

At a block 412, the amount of data collected and stored at block 410 is evaluated. For example, a user may specify that the number of observations that must be collected by the routine 400, in which case, the collected data is compared to the user specification at block 412. If more data is necessary, control passes back to the block 408 to collect more data. When the routine 400 determines that a sufficient amount of data has been collected at blocks 406 and 412, control passes to the dual model evaluation routine 450.

Turning to FIG. 5, the clean signature model and dirty signature model generated in routine 400 are used in the dual model evaluation routine 450 to evaluate the current conditions of the boiler section 200 and determine whether to modify the operations of the soot blowers. The routine 450 begins at a block 452 wherein the current process data for the boiler section 200 is collected. The collected data may be the same data collected at blocks 402, 408 of routine 400 for the generation of the clean and dirty signature models. With the data collected at block 452, control passes to blocks 454 and 456 wherein the collected current data is input into the clean and dirty signature models to calculate the ideal and dirty conditions of the boiler section 200. The ideal condition for the boiler section 200 is calculated at the block 454 in a similar manner as previously discussed for block 308 of the control program 300. For the sake of consistency, the heat absorption of the boiler section 200 will again be used as the representative parameter for indicating the condition of the boiler section 200. Consequently, the clean signature model generates a value for $Q_{ideal}$ to be used in evaluating the soot blowing operation. However, those skilled in the art will understand that other parameters may be used as the arbiter of the boiler or boiler section condition, and the use of other parameters in this manner is contemplated by the inventors.

At the block 456, the data collected at block 452 is input to the dirty signature model generated at block 410 of the routine 400 to generate a value for the heat absorption of the boiler section 200 at the dirtiest operating condition, or $Q_{dirty}$. As previously discussed, the dirty heat absorption $Q_{dirty}$ is the heat absorption, as calculated by the dirty signature model, of the value of the heat absorption at the point where the boiler section 200 should be taken out of service for maintenance and cleaning. The value of $Q_{dirty}$ will be used in determining the reliability of the generated models as discussed further below. Moreover, depending on the implementation, $Q_{dirty}$ may also be used in determining whether changes are required to the soot blowing operation where the models are found to be sufficiently reliable.

After calculating the ideal and dirty heat absorptions $Q_{ideal}$ and $Q_{dirty}$ at the blocks 454, 456, respectively, control passes to a block 458 wherein the routine 450 calculates other parameters that will be used in determining the reliability of the clean and dirty signature models, and whether the soot blowing operation must be adjusted. One parameter calculated at block 458 is the current actual heat absorption $Q_{actual}$ for the boiler section 200. $Q_{actual}$ may be calculated using any of the methods discussed above, but in particular may be calculated using the inlet and outlet enthalpies $H_i$ and $H_o$ and the steam flow rate F according to the equation described above.

With $Q_{actual}$ determined, along with $Q_{ideal}$ and $Q_{dirty}$ calculated using the clean and dirty signature models, the cleanliness factor CF and a dirtiness factor DF are calculated at the block 458. The cleanliness factor CF is calculated as discussed above as $Q_{actual}/Q_{ideal}$. Based on this equation, it will be apparent that the cleanliness factor CF should have a value ranging between 1 ($Q_{actual}=Q_{ideal}$) and zero (no heat absorption). However, in practice, the expected lower limit for the value of CF is approximately $Q_{dirty}/Q_{ideal}$, or the point at which the boiler section 200 approaches the dirtiness limit and the actual heat absorption approaches the dirty heat absorption.

The dirtiness factor DF is a measure of how close the current actual operating conditions of the boiler section 200 are to the point at which the boiler section 200 should be cleaned. Consequently, the dirtiness factor DF is calculated at block 458 as the ratio $Q_{dirty}/Q_{actual}$. As with the cleanliness factor CF, the dirtiness factor DF should have a value between zero and 1 ($Q_{actual}=Q_{dirty}$). Because $Q_{ideal}$ and $Q_{dirty}$ are ideally the upper and lower limits of $Q_{actual}$, the dirtiness factor DF should range between a minimum of $Q_{dirty}/Q_{ideal}$ and a maximum of 1 if the models are accurate and the boiler section 200 is taken out of service at the time of or before the performance of the boiler section 200 degrades to the dirty condition.

With CF and DF defined and calculated as discussed above, it will be apparent to those skilled in the art that as the cleanliness factor CF decreases as soot collects in the boiler section 200, the value of the dirtiness factor DF increases in a corresponding manner. In view of these relationships, at block 458, the routine 450 calculates a reliability factor K as the sum of the current calculated values of the cleanliness and dirtiness factors, or CF+DF. Where the clean and dirty signature models are reliable, the value of the reliability factor K is relatively constant over time for the anticipated operating range of the boiler section 200. Slight variations in the value of the reliability factor K may be tolerable and indicate a high level of confidence that the clean and dirty signature models are sufficiently accurate. However, large variations in the reliability factor K will indicate a low level of confidence in the accuracy of one or both of the models.

After the values of $Q_{ideal}$, CF, DF and K are calculated at block 458, control passes to a block 460 where the routine 450 evaluates the value of the reliability factor K against the acceptable range of values for the reliability factor K. The acceptable range of values may be determined and/or specified by a user based on the anticipated operating range of the particular boiler or boiler section being monitored. With the approximate values of $Q_{ideal}$ and $Q_{dirty}$ for the boiler or boiler section known, the range of values of CF, DF and K may be readily calculated as discussed further below. If the value of the reliability factor K is not within the specified acceptable range of values, and thereby indicating that the models are unreliable, control may be passed back to the dual model generation routine 400 of FIG. 4 so that blocks 402, 408 begin collecting data for the generation of new clean and dirty signature models.

If the value of the reliability factor K is within the acceptable range at block 460 indicating that the models are reliable, control passes to a block 462 to determine whether it is necessary to change the current operational sequencing of the soot blowers. The processing at block 462 may be similar to the processing at block 310 of the control program 300 as described above using the current data and the clean signature model to determine whether changes to the soot blowing operation are necessary. Alternatively, or in addition, the dirty signature model and dirtiness factor DF may be used at the block 462. If the block 462 determines that it is necessary to change the current operational sequencing of the soot blowers, a block 464 determines a change to be applied to any of the various parameters of the current operational sequencing to arrive at an updated second operational sequencing of the soot blowers. The block 464 may use various values of the parameters collected at the block 452 and other values calculated at the block 458 to determine the change to be applied to the operating parameters of the current operational sequencing. The changes to the operational sequencing of the soot blowers may include modifying (adding or subtracting) the soot blowers used in the operational sequencing, changing the blowing frequency of the current sequence, changing the time interval between discharges from the soot blowers within the current sequence, or any combination of these sequencing modifications and changes. The changes may also include determining a completely different operational sequence for the soot blowers. However, if the block 462 determines that current operational sequencing of the soot blowers is working effectively, and that it is not necessary to change the current operational sequencing of the soot blowers, control may transfer back to the block 452 for continuous monitoring of the soot blowing process without any changes.

As discussed above, the acceptable range of values for the reliability factor K may be determined based on the known or expected range of operating conditions for the monitored boiler section 200. Consequently, the person configuring the routines 400, 450 knows the approximate range of heat absorptions between the clean and dirty conditions. For example, in the various sections of power generation plants, the variations between clean and dirty conditions can be approximately 15% of the total heat absorption. Consequently, the water wall section can range from a clean heat absorption of 2,000 MBtu/Hr to a dirty heat absorption of 1,700 MBtu/Hr, while the heat absorption of the reheat section can range from a maximum of approximately 800 MBtu/HR down to approximately 680 MBtu/Hr.

With expected values of the clean and dirty heat absorptions, acceptable values for the other current condition and reliability parameters can be calculated. Using the water wall section as an example, the heat absorption limits are expected to be $Q_{ideal}$=2,000 MBtu/Hr and $Q_{dirty}$=1,700 MBtu/Hr. $Q_{actual}$ at a given point in time should be within the expected range of heat absorptions. Given the information regarding the heat absorptions, we can determine the values of the cleanliness factor CF, the dirtiness factor DF, and the reliability factor K for the range of values of $Q_{actual}$ as shown in Table 1:

TABLE 1

| $Q_{actual}$ (MBtu/Hr) | CF | DF | K |
|---|---|---|---|
| 2,000 | 1.000 | 0.850 | 1.850 |
| 1,950 | 0.975 | 0.872 | 1.847 |
| 1,900 | 0.950 | 0.895 | 1.845 |
| 1,850 | 0.925 | 0.919 | 1.844 |
| 1,800 | 0.900 | 0.944 | 1.844 |
| 1,750 | 0.875 | 0.971 | 1.846 |
| 1,700 | 0.850 | 1.000 | 1.850 |

With the 15% variation in the heat absorption, the cleanliness factor CF ranges from 1.000 to 0.850, the dirtiness factor DF ranges from 0.850 to 1.000, and the reliability factor K ranges between 1.850 and 1.844. This represents the acceptable range for the reliability factor K for the water wall section that may be input to the evaluation routine 450. Depending on the user's knowledge of the controlled section, the routine 450 may be configured to allow for an acceptable amount of divergence from the range, such as ±1%, and still determine that the clean and dirty signature models are reliable.

With the routine 450 configured with the acceptable range for the reliability factor K, the control program may be executed to monitor and control the soot blowing operation for the water wall section. After the clean and dirty signature models are generated by the routine 400, the routine 450 evaluates the current conditions within the water wall section using the models. If the clean signature model yields a clean heat absorption $Q_{ideal}$ approximately equal to 2,000 MBtu/Hr and the dirty signature model yields a dirty heat absorption $Q_{dirty}$ approximately equal to 1,700 MBtu/Hr at the blocks 454, 456, respectively, based on the data collected at block 452, then a value for the reliability factor K that is within the acceptable range will be calculated at block 458 if the current actual heat absorption $Q_{actual}$ is between 1,700 and 2,000 MBtu/Hr. If, however, the value of the clean heat absorption $Q_{ideal}$ as calculated by the clean signature model differs significantly from the expected value, then the value of the reliability factor K will fall outside the acceptable range. For example, if the value of the clean heat absorption $Q_{ideal}$ calculated at block 454 is 2,100 MBtu/Hr and the value of the dirty heat absorption $Q_{dirty}$ is 1,700 MBtu/Hr, the reliability factor K will have a value of 1.807, or approximately 2% below the lower limit of 1.844, where the current actual heat absorption $Q_{actual}$ is 1,900 MBtu/Hr. Depending on the acceptable tolerance for divergence from the specified range for the reliability factor K, the value of 1.807 may indicate that the clean signature model is unreliable and cause block 460 to pass control back to the routine 400 to regenerate the clean and dirty signature models.

Although the forgoing text sets forth a detailed description of numerous different embodiments of the invention, it should be understood that the scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

What is claimed is:

1. A method of controlling soot blowers or a soot blower operating sequence located near a heat exchange section, the method comprising:

operating the soot blowers according to a first operating sequence;

generating a first model for a clean operating condition of the heat exchange section from process data of the heat exchange section;

generating a second model for a dirty operating condition of the heat exchange section from process data of the heat exchange section;

calculating an ideal operating condition of the heat exchange section using the first model;

calculating a dirty operating condition of the heat exchange section using the second model;

calculating a current operating condition of the heat exchange section based on current process data of the heat exchange section;

comparing the current operating condition to the ideal operating condition and to the dirty operating condition; and determining a second operating sequence and causing the soot blowers to operate according to the second operating sequence if the comparison of the current operation condition to the ideal operating condition and the comparison of the current operating condition to the dirty operating condition indicate that the first operating sequence is not an optimal operating sequence for the soot blowers.

2. A method of controlling soot blowers in accordance with claim 1, wherein calculating the ideal operating condition comprises calculating an ideal value of a process parameter that varies according to the cleanliness of the heat exchange section using the first model, wherein calculating the dirty operating condition comprises calculating a dirty value of the process parameter using the second model, and wherein calculating the current operating condition comprises calculating a current value of the process parameter based on the current process data of the heat exchange section.

3. A method of controlling soot blowers in accordance with claim 2, wherein the process parameter is the heat absorption by steam passing through the heat exchange section.

4. A method of controlling soot blowers in accordance with claim 2, wherein comparing the current operating condition comprises:

calculating a first ratio equal to an actual value of the process parameter divided by the ideal value of the process parameter; and calculating a second ratio equal to the dirty value of the process parameter divided by the actual value of the process parameter.

5. A method of controlling soot blowers in accordance with claim 4, comprising causing the soot blowers to operate according to the second operating sequence if the first ratio and the second ratio indicate that the first operating sequence is not the optimal operating sequence for the soot blowers.

6. A method of controlling soot blowers in accordance with claim 1, comprising:

calculating a reliability parameter indicative of the accuracy of the first model and the second model based on the current operating condition, the ideal operating condition and the dirty operating condition; and regenerating the first model and the second model if the value of the reliability factor is not within an acceptable range of values.

7. A method of controlling soot blowers in accordance with claim 6, wherein calculating the ideal operating condition comprises calculating an ideal value of a process parameter that varies according to heat exchange section cleanliness using the first model, wherein calculating the dirty operating condition comprises calculating a dirty value of the process parameter using the second model, wherein calculating the current operating condition comprises calculating a current value of the process parameter based on the current process data of the heat exchange section, and wherein calculating the reliability factor comprises:

calculating a first ratio equal to an actual value of the process parameter divided by the ideal value of the process parameter;

calculating a second ratio equal to the dirty value of the process parameter divided by the actual value of the process parameter; and adding the first ratio to the second ratio.

8. A method of controlling soot blowers or a soot blower operating sequence located near a heat exchange section, the method comprising:

generating a first model for a clean operating condition of the heat exchange section from process data of the heat exchange section;

generating a second model for a dirty operating condition of the heat exchange section from process data of the heat exchange section;

calculating an ideal operating condition of the heat exchange section using the first model;

calculating a dirty operating condition of the heat exchange section using the second model;

calculating a current operating condition of the heat exchange section based on current process data of the heat exchange section;

calculating a reliability parameter indicative of the accuracy of the first model and the second model based on the current operating condition, the ideal operating condition and the dirty operating condition; and regenerating the first model and the second model if the value of the reliability parameter is not within an acceptable range of values.

9. A method of controlling soot blowers in accordance with claim 8, wherein calculating the ideal operating condition comprises calculating an ideal value of a process parameter that varies according to heat exchange section cleanliness using the first model, wherein calculating the dirty operating condition comprises calculating a dirty value of the process parameter using the second model, wherein calculating the current operating condition comprises calculating a current value of the process parameter based on the current process data of the heat exchange section, and wherein calculating the reliability parameter comprises:

calculating a first ratio equal to an actual value of the process parameter divided by the ideal value of the process parameter;

calculating a second ratio equal to the dirty value of the process parameter divided by the actual value of the process parameter; and adding the first ratio to the second ratio.

10. A method of controlling soot blowers in accordance with claim 9, wherein the process parameter is the heat absorption by steam passing through the heat exchange section.

11. A method of controlling soot blowers in accordance with claim 8, comprising:

operating the soot blowers according to a first operating sequence;

comparing the current operating condition of the heat exchange section based on current process data of the heat exchange section to the ideal operating condition and the dirty operating condition; and determining a second operating sequence and causing the soot blowers to operate according to the second operating sequence if the comparison of the current operation condition to the ideal operating condition and the comparison of the current operating condition to the dirty operating condition indicate that the first operating sequence is not an optimal operating sequence for the soot blowers.

12. A method of controlling soot blowers in accordance with claim 11, wherein calculating the ideal operating condition comprises calculating an ideal value of a process parameter that varies according heat exchange section cleanliness using the first model, wherein calculating the dirty operating condition comprises calculating a dirty value of the process parameter using the second model, and wherein calculating the current operating condition comprises calculating a current value of the process parameter based on the current process data of the heat exchange section.

13. A method of controlling soot blowers in accordance with claim 12, wherein comparing the current operating condition comprises:

calculating a first ratio equal to an actual value of the process parameter divided by the ideal value of the process parameter;

calculating a second ratio equal to the dirty value of the process parameter divided by the actual value of the process parameter; and causing the soot blowers to operate according to the second operating sequence if the first ratio and the second ratio indicate that the first operating sequence is not the optimal operating sequence for the soot blowers.

14. A soot blowing process control system for controlling soot blowers located near a heat exchange section, the system comprising:

a computer processor communicatively connected to the soot blowers;

a computer readable memory;

a first routine stored on the computer readable memory and adapted to be operable on the computer processor to operate the soot blowers according to a first operating sequence;

a second routine stored on the computer readable memory and adapted to be operable on the computer processor to generate a first model for a clean operating condition of the heat exchange section from process data of the heat exchange section;

a third routine stored on the computer readable memory and adapted to be operable on the computer processor to generate a second model for a dirty operating condition of the heat exchange section from process data of the heat exchange section;

a fourth routine stored on the computer readable memory and adapted to be operable on the computer processor to calculate an ideal operating condition of the heat exchange section using the first model;

a fifth routine stored on the computer readable memory and adapted to be operable on the computer processor to calculate a dirty operating condition of the heat exchange section using the second model;

a sixth routine stored on the computer readable memory and adapted to be operable on the computer processor to calculate a current operating condition of the heat exchange section based on current process data of the heat exchange section;

a seventh routine stored on the computer readable memory and adapted to be operable on the computer processor to compare the current operating condition to the ideal operating condition and to the dirty operating condition; and an eighth routine stored on the computer readable memory and adapted to be operable on the computer processor to determine a second operating sequence and cause the soot blowers to operate according to the second operating sequence if the comparison of the current operation condition to the ideal operating condition and the comparison of the current operating condition to the dirty operating condition indicate that the first operating sequence is not an optimal operating sequence for the soot blowers.

15. A soot blowing process control system in accordance with claim 14, wherein the fourth routine is further adapted to calculate an ideal value of a process parameter that varies according to heat exchange section cleanliness using the first model, wherein the fifth routine is further adapted to calculate a dirty value of the process parameter using the second model, and wherein the sixth routine is further adapted to calculate a current value of the process parameter based on the current process data of the heat exchange section.

16. A soot blowing process control system in accordance with claim 15, wherein the seventh routine is further adapted to calculate a first ratio equal to an actual value of the process parameter divided by the ideal value of the process parameter, and to calculate a second ratio equal to the dirty value of the process parameter divided by the actual value of the process parameter.

17. A soot blowing process control system in accordance with claim 16, wherein the eighth routine is further adapted to cause the soot blowers to operate according to the second operating sequence if the first ratio and the second ratio indicate that the first operating sequence is not the optimal operating sequence for the soot blowers.

18. A soot blowing process control system in accordance with claim 14, comprising a ninth routine stored on the computer readable memory and adapted to be operable on the computer processor to calculate a reliability parameter indicative of the accuracy of the first model and the second model based on the current operating condition, the ideal operating condition and the dirty operating condition, wherein the second routine is further adapted to regenerate the first model if the value of the reliability parameter is not within an acceptable range of values, and the third routine is further adapted to regenerate the second model if the value of the reliability parameter is not within an acceptable range of values.

19. A soot blowing process control system in accordance with claim 18, wherein the fourth routine is further adapted to calculate an ideal value of a process parameter that varies according heat exchange section cleanliness using the first model, wherein the fifth routine is further adapted to calculate a dirty value of the process parameter using the second model, wherein the sixth routine is further adapted to calculate a current value of the process parameter based on the current process data of the heat exchange section, and wherein the ninth routine is further adapted to calculate a first ratio equal to an actual value of the process parameter divided by the ideal value of the process parameter, to calculate a second ratio equal to the dirty value of the process parameter divided by the actual value of the process parameter, and to add the first ratio to the second ratio.

20. A soot blowing process control system for controlling soot blowers located near a heat exchange section, the system comprising:

a computer processor communicatively connected to the soot blowers;

a computer readable memory;

a first routine stored on the computer readable memory and adapted to be operable on the computer processor to generate a first model for a clean operating condition of the heat exchange section from process data of the heat exchange section;

a second routine stored on the computer readable memory and adapted to be operable on the computer processor to generate a second model for a dirty operating condition of the heat exchange section from process data of the heat exchange section;

a third routine stored on the computer readable memory and adapted to be operable on the computer processor to calculate an ideal operating condition of the heat exchange section using the first model;

a fourth routine stored on the computer readable memory and adapted to be operable on the computer processor to calculate a dirty operating condition of the heat exchange section using the second model;

a fifth routine stored on the computer readable memory and adapted to be operable on the computer processor to calculate a current operating condition of the heat exchange section based on current process data of the heat exchange section;

a sixth routine stored on the computer readable memory and adapted to be operable on the computer processor to calculate a reliability parameter indicative of the accuracy of the first model and the second model based on the current operating condition, the ideal operating condition and the dirty operating condition; and a seventh routine stored on the computer readable memory and adapted to be operable on the computer processor to regenerate the first model and the second model if the value of the reliability parameter is not within an acceptable range of values.

21. A soot blowing process control system in accordance with claim 20, wherein the third routine is further adapted to calculate the ideal operating condition comprises calculating an ideal value of a process parameter that varies according to heat exchange section cleanliness using the first model, wherein the fourth routine is further adapted to calculate the dirty operating condition comprises calculating a dirty value of the process parameter using the second model, wherein the fifth routine is further adapted to calculate the current operating condition comprises calculating a current value of the process parameter based on the current process data of the heat exchange section, and wherein the sixth routine is further adapted to calculate a first ratio equal to an actual value of the process parameter divided by the ideal value of the process parameter, to calculate a second ratio equal to the dirty value of the process parameter divided by the actual value of the process parameter, and to add the first ratio to the second ratio.

22. A soot blowing process control system in accordance with claim 20, comprising:

an eighth routine stored on the computer readable memory and adapted to be operable on the computer processor to operate the soot blowers according to a first operating sequence;

a ninth routine stored on the computer readable memory and adapted to be operable on the computer processor to compare the current operating condition of the heat exchange section based on current process data of the heat exchange section; and a tenth routine stored on the computer readable memory and adapted to be operable on the computer processor to determine a second operating sequence and causing the soot blowers to operate according to the second operating sequence if the comparison of the current operation condition to the ideal operating condition and the comparison of the current operating condition to the dirty operating condition indicate that the first operating sequence is not an optimal operating sequence for the soot blowers.

23. A soot blowing process control system in accordance with claim 22, wherein the third routine is further adapted to calculate an ideal value of a process parameter that varies according to the cleanliness of the heat exchange section using the first model, wherein the fourth routine is further adapted to calculate the dirty operating condition comprises calculating a dirty value of the process parameter using the second model, and wherein the fifth routine is further adapted to calculate the current operating condition comprises calculating a current value of the process parameter based on the current process data of the heat exchange section.

24. A soot blowing process control system in accordance with claim 23, wherein the ninth routine is further adapted to calculate a first ratio equal to an actual value of the process parameter divided by the ideal value of the process parameter, and to calculate a second ratio equal to the dirty value of the process parameter divided by the actual value of the process parameter, and wherein the tenth routine is further adapted to cause the soot blowers to operate according to the second operating sequence if the first ratio and the second ratio indicate that the first operating sequence is not the optimal operating sequence for the soot blowers.

* * * * *